United States Patent [19]

Martelli

[11] 4,258,919

[45] Mar. 31, 1981

[54] FIVE-SUIT GAME DICE

[76] Inventor: Maurizio Martelli, Viale Abruzzi, 91, Milan, Italy

[21] Appl. No.: 33,542

[22] Filed: Apr. 26, 1979

[30] Foreign Application Priority Data

Apr. 3, 1978 [IT] Italy ..... 21365/78[U]

[51] Int. Cl.[3] ..... A63F 9/04

[52] U.S. Cl. ..... 273/146

[58] Field of Search ..... 273/146, 156; 35/69, 35/70, 71; D21/37, 41

[56] References Cited

U.S. PATENT DOCUMENTS

| | | | |
|---|---|---|---|
| 614,524 | 11/1898 | Yardley | 273/146 |
| 645,112 | 3/1900 | Mapes | 273/146 |
| 646,463 | 4/1900 | Schossow | 273/156 |
| 1,481,628 | 1/1924 | Souza | 273/146 |
| 2,024,541 | 12/1935 | Silkman | 273/146 UX |

FOREIGN PATENT DOCUMENTS

| | | | |
|---|---|---|---|
| 648549 | 8/1928 | France | 273/146 |
| 7206131 | 10/1973 | France | 273/146 |
| 757509 | 9/1956 | United Kingdom | 273/146 |

OTHER PUBLICATIONS

"Poker Dice", Playthings, May 1969, p. 30.

*Primary Examiner*—Richard C. Pinkham
*Assistant Examiner*—Arnold W. Kramer
*Attorney, Agent, or Firm*—Lane, Aitken, Ziems, Kice & Kananen

[57] ABSTRACT

Set of five game dice, the faces of which have the reproduction of six symbols in scale similar to those of standard playing-cards; on the various dice the symbols have with respect to the faces the same arrangement, but a different combination of five different suits, except for the symbols of extreme value, which in each die are of the same suit, but different for each of the five dice.

3 Claims, 2 Drawing Figures

| | 9 | 10 | J | Q | K | A |
|---|---|---|---|---|---|---|
| 1° | F | C | AM | D | P | F |
| 2° | AM | D | P | F | C | AM |
| 3° | P | F | C | AM | D | P |
| 4° | C | AM | D | P | F | C |
| 5° | D | P | F | C | AM | D |

| | 9 | 10 | J | Q | K | A |
|---|---|---|---|---|---|---|
| 1° | F | C | AM | D | P | F |
| 2° | AM | D | P | F | C | AM |
| 3° | P | F | C | AM | D | P |
| 4° | C | AM | D | P | F | C |
| 5° | D | P | F | C | AM | D |

FIVE-SUIT GAME DICE

This invention relates to a set of five game dice with five suits, that is a set in which on the faces of the individual dice the symbols are reproduced of the standard playing-cards with the relative four conventional suits, plus a fifth suit which is different from the others and hereinafter referred to as "friends".

As well known, a game such as poker can be played in addition to by cards, as conventional, also with a set of five dice, on which some of the card symbols are reproduced, such as those taken on an increasing scale from nine to ace, having a predetermined arrangement with respect to the faces of the dice.

Conventional dice are all equal to one another not only in the arrangement of the various symbols, but also in the use of only one suit for the symbols such as ace, nine and ten and of no suit for the other three symbols, such as jack, queen and king of all the five dice. This results in a restriction of the number of play combinations that can be obtained, in connection with the card play, as combinations of different suits and/or colours cannot be provided.

It is the object of the present invention to provide a set of five dice, the faces of which have preset arrangements of symbols and suits, of which four conventional suits corresponding to the standard suits of playing-cards, plus a fifth additional suit commonly referred to as "friends".

Unlike the conventional dice, it is possible by the dice according to the present invention to realize a higher number of combinations, or to realize quite new combinations, thus considerably increasing the game possibilities.

Generally, according to the invention, a set of five dice is provided, in which the standard symbols of playing-cards are reproduced on the faces of each die according to a preset sequence of values, the symbols on the faces of the various dice having the same arrangement, but a different combination with five different suits, except for the symbols of extreme value which in each die are of the same suit, but different for each die. Additionally, the various suits or groups of suits may have colourings or combinations of colours different from one another, for example red or orange and other for the conventional suits of hearts and diamonds, black or blue or other colours for the conventional suits of spades and clubs, and a combination of said colours or a different colour, for example gold, for the fifth suit of "friends".

The five-suit game dice according to the present invention will now be further described with reference to the accompanying drawing, in which.

Figures 1, 2:
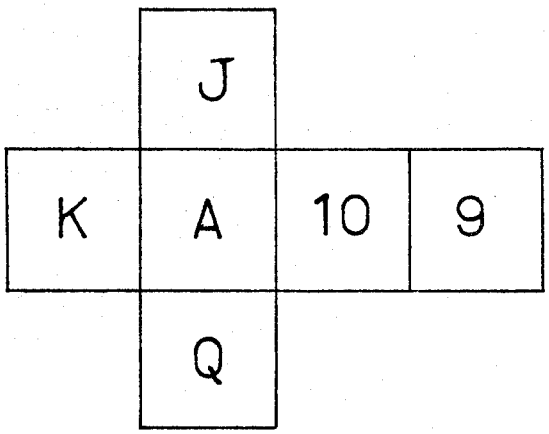
FIG. 1 is a plane development for the six faces of a die.
FIG. 2 is a representative table for the distribution of the various symbols and suits on the faces of the five dice.

For the purposes of the presente description, it should be noted that by symbols 9, 10, J, Q, K and A, the symbols have been schematically indicated for the values from nine to ace of the standard playing-cards, as reproduced on the six faces of a die, while in the table shown in FIG. 2, said symbols have been again indicated on the first horizontal line, the order of the five dice has been shown on the first leftside column, while the other columns show the various combinations of suits for each value and for each die, according to the following scheme:

F=clubs

D=diamonds

C=hearts

P=spades

AM=friends

From the plane development of a die shown in FIG. 1, it will be seen that the symbol distribution on the various faces follows the standard "seven" rule, assigning a score from 1 to 6 to the various symbols in scale from nine to ace. Therefore, on the pairs of opposite faces of each die there will be the symbols of nine and ace; jack and queen; and ten and king.

In the scheme of FIG. 2 there are otherwise indicated the different combinations for the symbols and suits allowing to obtain not only the standard play or game combinations, such as pair, two pairs, tris (three of a kind), straight, full, poker or super-poker, but also other combinations, such as colour, that is to say any sequence not in scale of symbols all of the same colour; straight flush, that is to say a scale sequence of symbols all of the same suit; as well as new combinations of five different suits in scale or new combinations for dice, such as straight flush, as well as a further combination similar to straight flush, in which from the symbol of lowest value and proceeding to the symbol of highest value, the following sequence of suits is provided: clubs, diamonds, hearts, spades and friends, or the added fifth suit.

Therefore, in order to realize the above cited combination possibilities, the five dice should have the sequence of symbols and suits of FIG. 2, wherein it is:

First die: nine of clubs, ten of hearts, jack of friends, queen of diamonds, king of spades and ace of clubs.

Second dice: Nine of friends, ten of diamonds, jack of spades, queen of clubs, king of hearts and ace of friends.

Third die: Nine of spades, ten of clubs, jack of hearts, queen of friends, king of diamonds and ace of spades.

Fourth die: Nine of hearts, ten of friends, jack of diamonds, queen of spades, king of clubs and ace of hearts.

Fifth die: Nine of diamonds, ten of spades, jack of clubs, queen of hearts, king of friends and ace of diamonds.

I claim:

1. A set of five game dice, the faces of which have the reproduction of six different symbols arranged according to the usual progression of standard international playing-cards, characterized in that on the various dice the symbols have in connection with the faces of the same arrangement, but a different combination of five different suits, except for the symbols of extreme value, which in each die are of a same suit, but different for each of the five dice.

2. A set of five game dice according to claim 1, characterized by the following combination of symbols and suits in each of the dice:

First die: nine of clubs, ten of hearts, jack of friends, queen of diamonds, king of spades and ace of clubs;

Second die: nine of friends, ten of diamonds, jack of spades, queen of clubs, king of hearts and ace of friends;

Third die: nine of spades, ten of clubs, jack of hearts, queen of friends, king of diamonds and ace of spades;

Fourth die: nine of hearts, ten of friends, jack of diamonds, queen of spades, king of clubs and ace of hearts;

Fifth die: nine of diamonds, ten of spades, jack of clubs, queen of hearts, king of friends and ace of diamonds.

3. A set of game dice according to claim 1, characterized in that the various suits or groups of suits have colors or combinations of colors different from one another.

* * * * *

UNITED STATES PATENT AND TRADEMARK OFFICE

CERTIFICATE OF CORRECTION

PATENT NO. : 4,258,919

DATED : March 31, 1981

INVENTOR(S) : MAURIZIO MARTELLI, Milano, Italy

It is certified that error appears in the above—identified patent and that said Letters Patent is hereby corrected as shown below:

On the Cover Sheet, in the first column, delete:

"[30] Foreign Application Priority Data

Apr. 3, 1978 [IT] Italy ..... 21365/78[U]";

and

Column 2, Line 45, after the word "faces" delete the word "of".

Signed and Sealed this

*Twenty-second* Day of *September 1981*

[SEAL]

*Attest:*

GERALD J. MOSSINGHOFF

*Attesting Officer*

*Commissioner of Patents and Trademarks*